US006877429B2

(12) United States Patent
Kusaka et al.

(10) Patent No.: US 6,877,429 B2
(45) Date of Patent: Apr. 12, 2005

(54) ROLLER HOLDING APPARATUS OF PRINTING PRESS

(75) Inventors: Akehiro Kusaka, Chiba (JP); Isao Komuro, Chiba (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 10/318,156

(22) Filed: Dec. 13, 2002

(65) Prior Publication Data

US 2003/0110964 A1 Jun. 19, 2003

(30) Foreign Application Priority Data

Dec. 17, 2001 (JP) ..... 2001-382503

(51) Int. Cl.[7] ..... B41F 13/20; B41L 35/12

(52) U.S. Cl. ..... 101/479; 101/145; 101/247; 101/480

(58) Field of Search ..... 101/144, 145, 101/247, 352.01, 352.03, 352.04, 425, 479, 480

(56) References Cited

U.S. PATENT DOCUMENTS 3,757,689 A * 9/1973 Koch et al. ..... 101/148
3,976,007 A * 8/1976 Junghans et al. ..... 101/425
4,130,057 A * 12/1978 List et al. ..... 101/148
4,475,456 A * 10/1984 Ishii et al. ..... 101/144
4,878,427 A * 11/1989 Washchynsky et al. ..... 101/219
5,005,474 A * 4/1991 Rebel et al. ..... 101/148
5,339,736 A * 8/1994 Dorsam et al. ..... 101/352.02
5,555,806 A 9/1996 Nawrath
5,683,202 A 11/1997 Hummel et al.
5,806,428 A * 9/1998 Koppelkamm et al. 101/352.04
6,490,973 B1 * 12/2002 Bosen et al. ..... 101/216

FOREIGN PATENT DOCUMENTS

JP 2588289 Y2 10/1998
JP 2000-94648 A 4/2000

* cited by examiner

*Primary Examiner*—Andrew H. Hirshfeld
*Assistant Examiner*—Jill E. Culler
(74) *Attorney, Agent, or Firm*—Birch, Stewart, Kolasch & Birch, LLP

(57) ABSTRACT

A roller holding apparatus of a printing press comprises roller arms swingably supported by a metal roller, holders swingably supported by the roller arms for holding a rubber roller so as to be detachably mounted on the roller arms, and pressing members provided in the holders for pressing the rubber roller against the metal roller. The roller holding apparatus can perform roller replacement easily and quickly with a simple structure, and can always retain a set nip pressure.

10 Claims, 12 Drawing Sheets

ROLLER HOLDING APPARATUS OF PRINTING PRESS

The entire disclosure of Japanese Patent Application No. 2001-382503 filed on Dec. 17, 2001 including specification, claims, drawings and summary is incorporated herein by reference in its entirety.

BACKGROUND OF THE INVENTION

1. Field of the Invention

This invention relates to a holding apparatus for a roller, such as an ink roller, in a printing press such as a rotary press.

2. Description of the Related Art

In a rotary press or the like, there has so far been a device, as shown, for example, in FIG. 11 (see Japanese Unexamined Patent Publication No. 2000-94648), for replacing an ink roller which is located at a position where the ink roller is difficult to replace.

In this replacing device, a lever 101 is pivotally supported on a shaft of an adjacent ink roller 100. An ink roller 103, which is present at a position where the ink roller 103 is difficult to replace, is supported by the lever 101 via a bearing 102. By turning the lever 101, the ink roller 103, which is located at a position where it is difficult to replace, is moved to a position where it is easy to replace. At this position, the ink roller 103 is replaced.

In this device, however, an air cylinder 104 is used for adjusting nip pressure against a plate cylinder and the roller adjacent to the ink roller 103 located at the position where its replacement is difficult. Thus, a connecting mechanism 105 for connecting the lever 101 to the air cylinder 104 must be provided, making the entire mechanism complicated. Moreover, whenever the ink roller 103, located at the position where its replacement is difficult, is moved to the position where its replacement is easy, a screw (not shown) of the connecting mechanism 105 has to be turned manually and undone. A work load is imposed on an operator, and it takes time to replace the ink roller.

As an automatic nip pressure adjusting mechanism for an adjacent roller, there is, for example, one as shown in FIG. 12 (Japanese Utility Model Registration No. 2588289).

In this automatic nip pressure adjusting mechanism, a slot 202 is provided in an arm 201 supported on an adjacent roller 200, a protuberance 205 is provided on a holder 204 of a roller 203, and a hole is provided in a front end portion of the protuberance 205. The protuberance 205 of the holder 204 is inserted through the slot 202 of the arm 201, and a rod 207 supported by a pin 206 supported by the arm 201 is inserted through the hole of the protuberance 205 of the holder 204. A helical compression spring 209 is provided between the protuberance 205 of the holder 204 and a locking nut 208 of the rod 207. Thus, the automatic nip pressure adjusting mechanism is large in the number of the components, high in the cost, and complicated in the mechanism. Provision of this automatic nip pressure adjusting mechanism in the surroundings of the ink roller 103 located at the aforementioned position, where the replacement of the ink roller 103 is difficult, presents difficulty in terms of space, and is not acceptable at all.

SUMMARY OF THE INVENTION

The present invention has been accomplished to solve the above-described problems with the earlier technologies. It is the object of the invention to provide a roller holding apparatus of a printing press which can perform roller replacement easily and promptly with a simple structure, and which can always retain a set nip pressure.

According to the present invention, for attaining the above object, there is provided a roller holding apparatus of a printing press, comprising:

a first roller supported rotatably;

an arm supported swingably;

a holder, swingably supported by the arm, for holding a second roller so as to be detachably mounted on the arm; and a pressing member, provided in the holder, for pressing the second roller against the first roller.

According to this feature, roller replacement can be performed easily and quickly with a simple structure, and a set nip pressure can be always retained.

In the roller holding apparatus of a printing press, the pressing member may urge the second roller toward the first roller by a first elastic member.

In the roller holding apparatus of a printing press, the pressing member may comprise a first depression provided in the holder on a side of the second roller; a first hole provided in the holder and communicating with the first depression; a first pin inserted into the first hole and provided with a contact portion in contact with the second roller; and a first elastic member interposed between the bottom of the first depression and the contact portion of the first pin.

In the roller holding apparatus of a printing press, the pressing member may further comprise pressing force adjusting means for adjusting the pressing force of the pressing member.

In the roller holding apparatus of a printing press, the pressing member having the pressing force adjusting means may comprise a first hole provided in the holder and having a threaded portion provided in the inside thereof; an adjusting screw screwed into the threaded portion of the first hole and having a hole; a first pin inserted into the hole of the adjusting screw and having a contact portion in contact with the second roller; and a first elastic member interposed between the adjusting screw and the contact portion of the first pin.

The roller holding apparatus of a printing press may further comprise a second hole provided in one of the arm and the holder; a second pin provided in the other of the arm and the holder; and a second elastic member for urging the second pin toward the second hole.

The roller holding apparatus of a printing press may further comprise holding means for holding the arm at a replacement position where the second roller is replaced, and at a printing position where the second roller contacts a third roller.

In the roller holding apparatus of a printing press, the holding means may include first and second brackets fixed to a frame of the printing press; depressions provided in the first and second brackets or in the arm; and a fixing pin provided in the arm if the depressions are provided in the first and second brackets, or the fixing pin being provided in the first and second brackets if the depressions are provided in the arm, and the fixing pin being insertable into the depression provided in the first and second brackets or in the arm.

In the roller holding apparatus of a printing press, the holding means may include a stopper member fixed to a frame of the printing press; a stopper portion provided in the arm; and an actuator pivotally supported by the arm.

In the roller holding apparatus of a printing press, the holding means may include a stopper member fixed to a frame of the printing press; a stopper portion provided in the arm; and a second elastic member pivotally supported by the arm.

In the roller holding apparatus of a printing press, the arm may be provided with a handgrip for swinging the arm.

In the roller holding apparatus of a printing press, the arm may be supported so as to be swingable between a printing position where the second roller is in contact with the first roller and a third roller and printing is performed, and a replacement position where the second roller is separated from the third roller and the second roller is replaced.

In the roller holding apparatus of a printing press, the holder may be supported so as to be swingable between a holding position where the second roller is held by the arm, and a release position where the second roller can be replaced from and mounted on the arm, and the holder may be swung to the release position, with the arm being located at the replacement position, whereby the second roller can be replaced.

In the roller holding apparatus of a printing press, the pressing member may, at least, include a spring, and the arm may be located at the printing position, whereby a constant pressure against the first roller and the third roller is imparted to the second roller by the spring.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Embodiments of the roller holding apparatus of the printing press according to the present invention will now be described in detail with reference to the accompanying drawings, which in no way limit the invention.

First Embodiment

Figure 1:
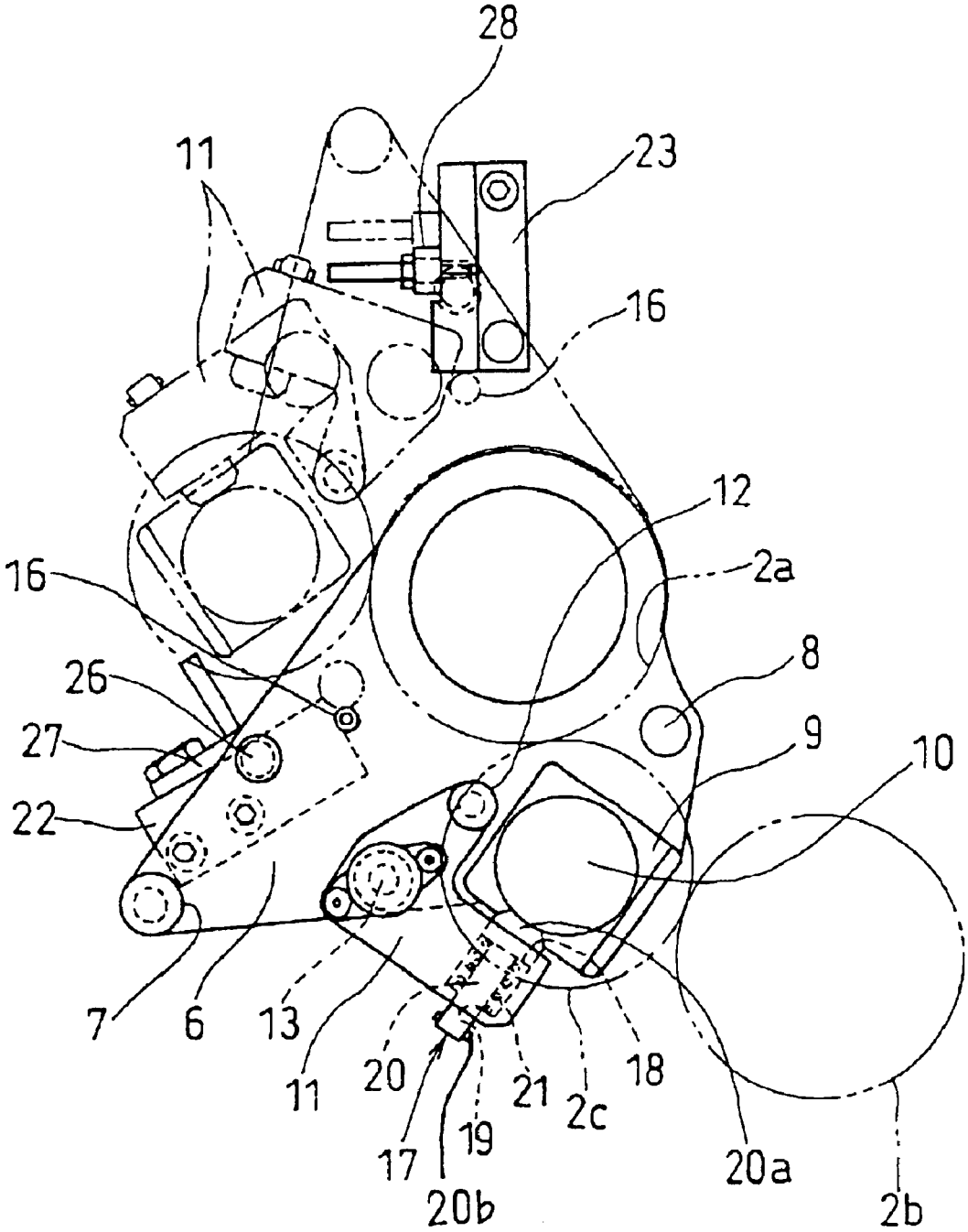
FIG. 1 is a side view of the essential parts of an inking device showing a first embodiment of the present invention.
Figure 2:
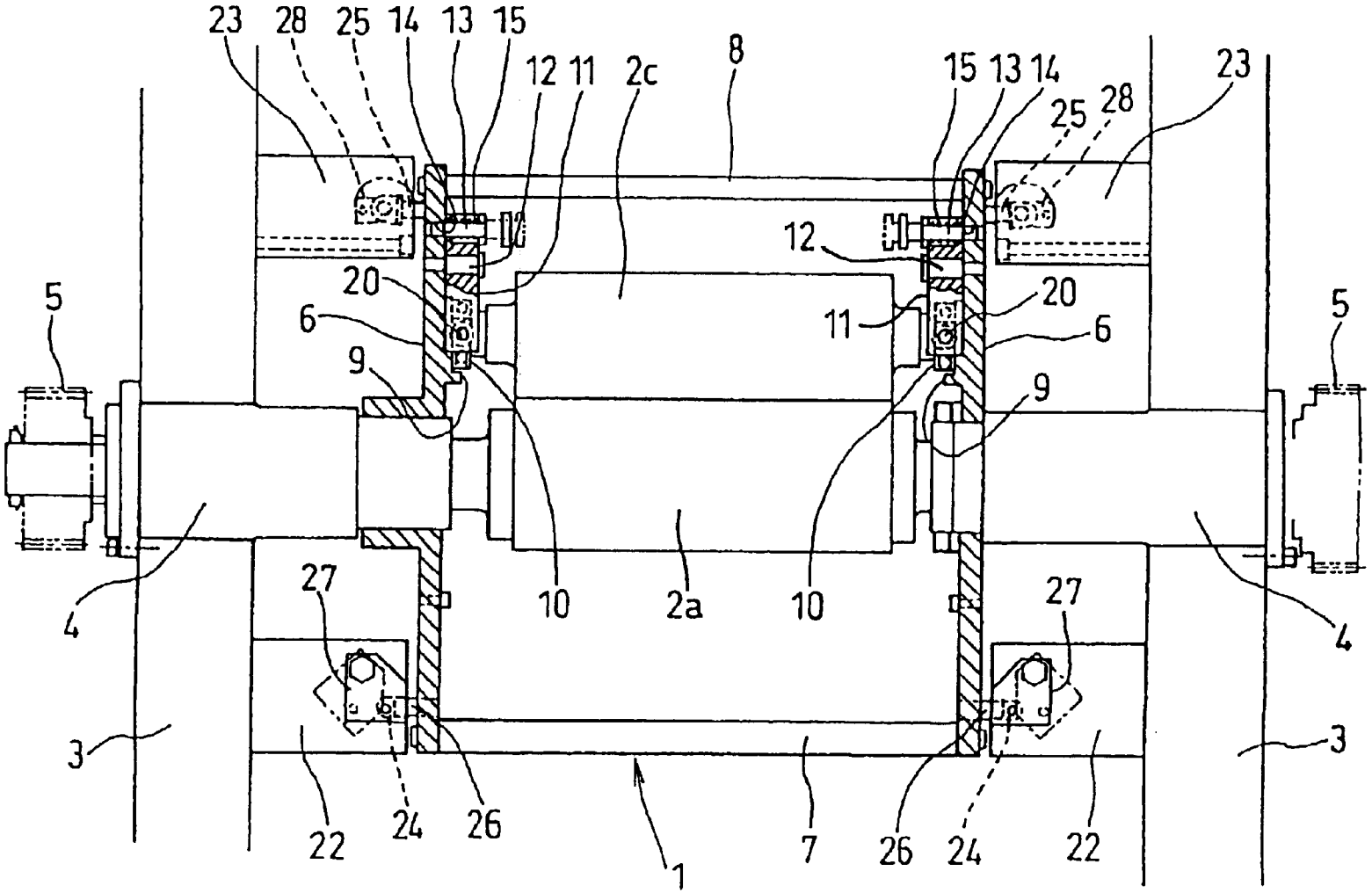
FIG. 2 is a partly cutaway, developed plan view of the essential parts of the inking device.
Figure 3:
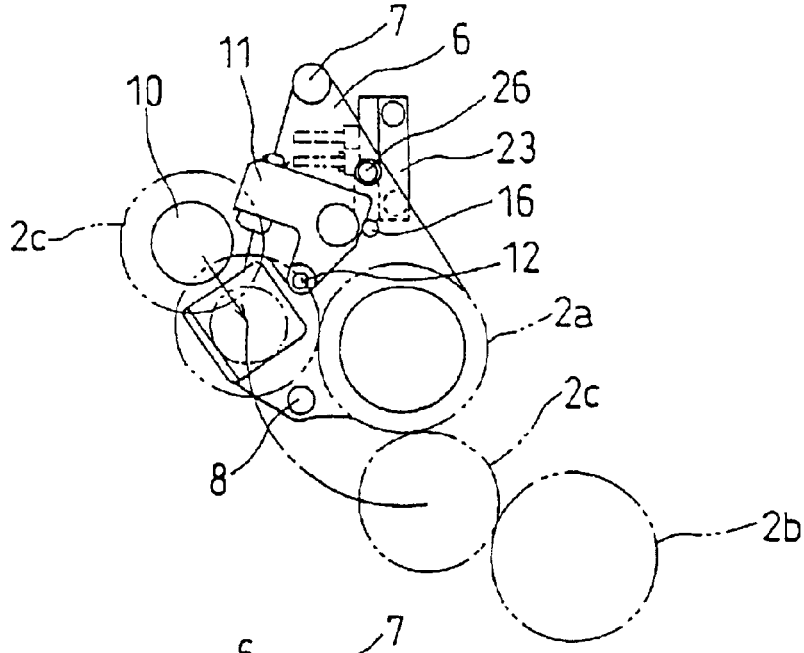
FIGS. 3(*a*) to 3(*c*) are views illustrating actions of the essential parts of the inking device.
Figure 3:
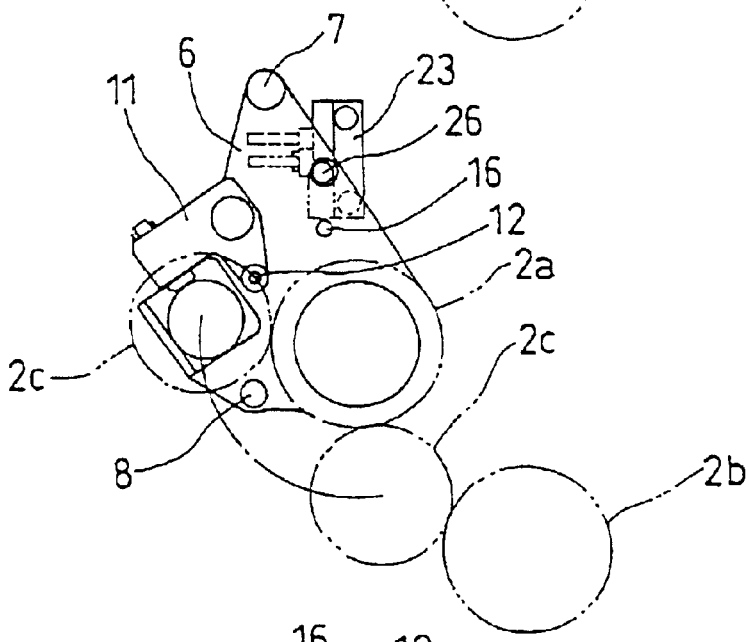
Figure 3:
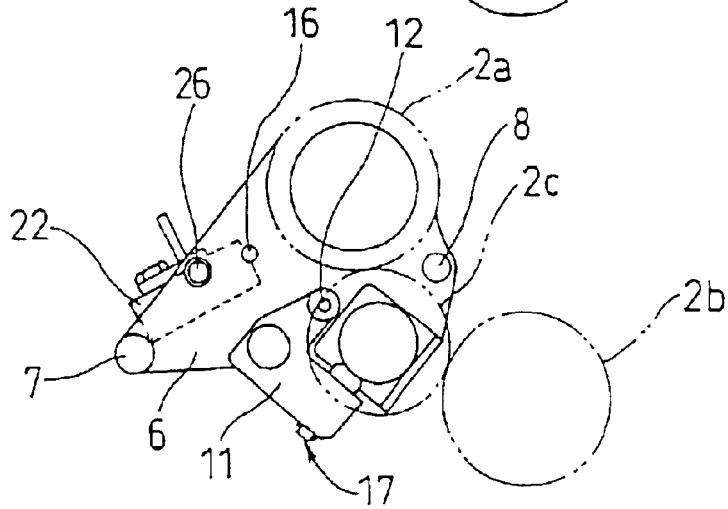
Figure 4:
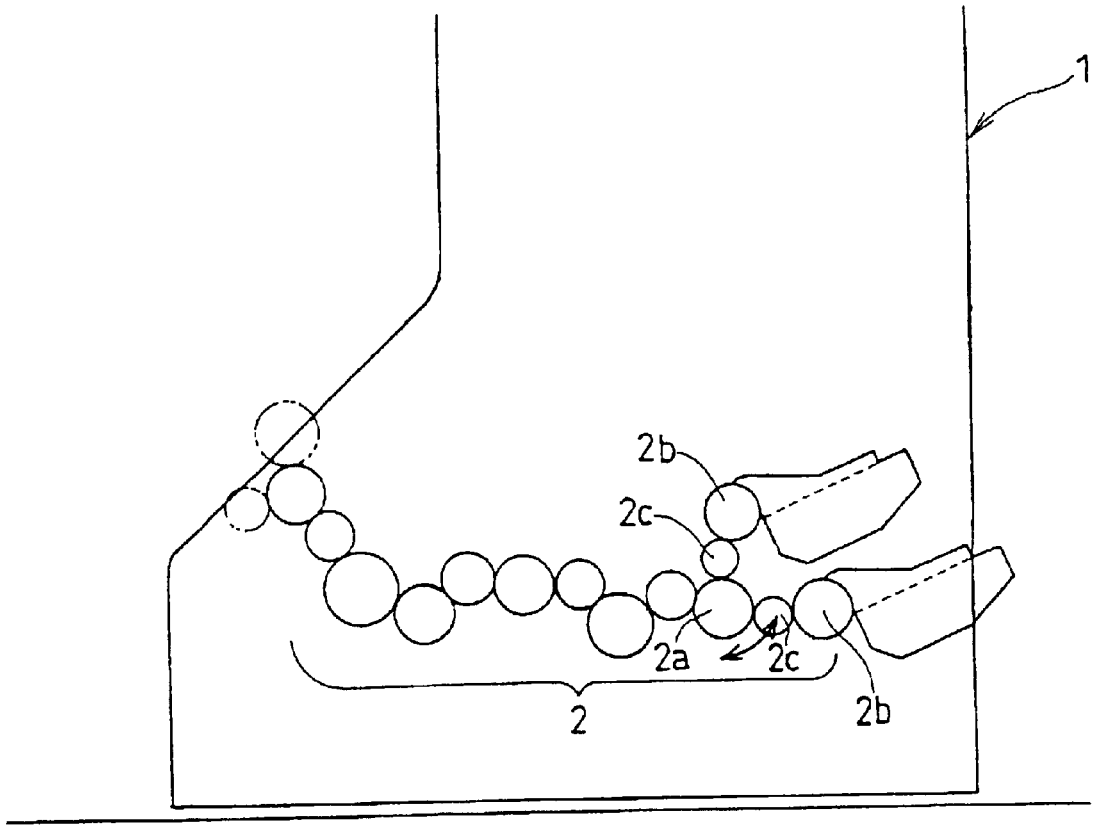
FIG. 4 is a side view of an inking unit of the inking device.

FIG. 1 is a side view of the essential parts of an inking device showing a first embodiment of the present invention. FIG. 2 is a developed plan view of the essential parts of the inking device. FIGS. 3(*a*) to 3(*c*) are views illustrating actions of the essential parts of the inking device. FIG. 4 is a side view of an inking unit of the inking device.

Of ink rollers 2 in an inking device (inking unit) 1 of a rotary press capable of rainbow printing, as shown in FIG. 4, a rubber roller (second roller) 2*c* disposed between metal rollers (first and third rollers) 2*a* and 2*b* can be replaced where necessary. The rubber roller 2*c* in the lowest stage at a position, where it is difficult to replace, can be moved by the present roller holding apparatus between a printing position and a replacement/mounting position, as indicated by arrows in the drawing.

A detailed description will be presented by reference to FIGS. 1 and 2. The metal roller 2*a* is rotatably supported between right and left frames 3 of the inking device 1 via bearings 4. A driving force is transmitted from a drive source (not shown) via gears 5 joined to the shaft ends of the metal roller 2*a*.

Triangular roller arms 6 are pivotally (swingably) supported at shaft portions on both sides of a roller body of the metal roller 2*a* located inwardly of the bearings 4. Front portions of the roller arms 6 are connected by a width determining/reinforcing handgrip 7, while rear portions of the roller arms 6 are connected by a width determining/reinforcing stay 8.

A bearing support portion 9 is provided on the inner surface of an intermediate portion of each of the roller arms 6. The rubber roller 2*c* is rotatably supported between the bearing support portions 9 via bearings 10. Right and left holders 11, as a pair, each in the shape of a bell crank (to be described later) enable the rubber roller 2*c* to be mounted on and dismounted from the roller arms 6, together with the bearings 10.

The holder 11 is pivotally (swingably) supported at one end portion thereof by a pin 12. A positioning pin (second pin) 13 provided in an intermediate portion of the holder 11 is inserted into and engaged with an engagement hole (second hole) 14 formed in the roller arm 6. By these means, the rubber roller 2*c* is unremovably held by the roller arm 6. The positioning pin 13 is always urged by a compression spring (second elastic member) 15 in a direction in which the positioning pin 13 protrudes from the holder 11 toward the roller arm 6.

When, at the replacement/mounting position of the rubber roller 2*c* (see chain lines shown in FIG. 1), the holder 11 is pivoted (swung) clockwise in FIG. 1 until it hits an engagement pin (stopper pin) 16 formed on the roller arm 6, the holder 11 is stably fixed at this position, and the rubber roller 2*c* can be replaced from and mounted on the roller arm 6.

A pressing member 17 for pressing the rubber roller 2*c* against the metal rollers 2*a*, 2*b* via an elastic member is provided in the other end portion of the holder 11. In the illustrated embodiment, the pressing member 17 comprises a depression (first depression) 18 provided in the holder 11 on a side of the rubber roller 2*c*, a hole (first hole) 19 provided in the holder 11 and communicating with the depression 18, a pin (first pin) 20 inserted into the hole 19 and having a contact portion 20*a* contacting the bearing 10 of the rubber roller 2*c*, and a compression spring (first elastic member) 21 interposed between the bottom of the depression 18 and the contact portion 20*a* of the pin 20. A stopper

20*b* is provided in the pin 20. The stopper 20*b* is designed to prevent the pin 20 from slipping out of the holder 11 when the holder 11 is pivoted (swung) from the position of FIG. 3(*b*) to the position of FIG. 3(*a*).

Thus, at the printing position of the rubber roller 2*c* (see solid lines shown in FIG. 1), the bearing 10 of the rubber roller 2*c* is pressed in the bearing support portion 9 in a predetermined direction by the compression spring 21, whereby the nip pressure of the rubber roller 2*c* against the metal rollers 2*a*, 2*b* is always kept constant.

The roller arm 6 is selectively positioned and fixed by holding means at the printing position and the replacement/mounting position of the rubber roller 2*c*. In the illustrated embodiment, the holding means comprises a printing position fixing bracket 22 and a replacement/mounting position fixing bracket 23 secured to each of the right and left frames 3, depressions 24 and 25 provided in the brackets 22 and 23 (or the roller arm 6), a fixing pin 26 provided in the roller arm 6 (or the brackets 22 and 23) and insertable into the depression 24 or 25, and handle-equipped pivot covers 27 and 28 capable of closing the depressions 24 and 25 while the fixing pin 26 is being inserted into the depression 24 or 25.

The roller holding apparatus of the present invention is constructed as described above. Next, its actions will be described with reference to FIGS. 3(*a*) to 3(*c*).

At the printing position of the rubber roller 2*c*, as shown in FIG. 3(*c*), the roller arm 6 is positioned and fixed at the printing position fixing bracket 22 via the fixing pin 26 as stated earlier.

In this state, the rubber roller 2*c* is held by the holder 11 so as to be unremovable from the roller arm 6, and is brought into contact with the metal rollers 2*a* and 2*b* by being elastically urged by the pressing member 17 provided in the holder 11 as stated earlier.

Under this urging force, the nip pressure (width), which affects printing quality, is always constant and requires no adjusting operation, even if the roller diameter changes, for example, as a result of thermal expansion.

When the rubber roller 2*c* is to be replaced because of wear or the like, the engagement between the fixing pin 26 and the printing position fixing bracket 22 is released, then the handgrip 7 is gripped and moved to pivot (swing) the roller arm 6 clockwise about the shaft portion of the metal roller 2*a*, thereby positioning and fixing the roller arm 6 at the replacement/mounting position fixing bracket 23 via the fixing pin 26, as shown in FIG. 3(*b*).

At this time, the positional relation between the holder 11 and the roller arm 6 remains unchanged, so that the rubber roller 2*c* does not leave the metal roller 2*a* even when the roller arm 6 pivots (swings).

Then, as shown in FIG. 3(*a*), the holder 11 is pivoted (swung) clockwise about the pin 12 to make contact with the engaging pin 16. At this position, the holder 11 is fixed stably, as stated previously.

Consequently, the rubber roller 2*c*, together with the bearings 10, can be replaced and mounted relative to the roller arm 6.

According to the above-described simple structure in which the roller arm 6 equipped with the holder 11 requiring no nip pressure adjusting operation is pivoted (swung) about the shaft portion of the metal roller 2*a*, the rubber roller 2*c* is moved from the position where it is difficult to replace, to the position where it is easy to replace. Hence, roller replacement can be performed easily and quickly.

Also, the handles of the pivot covers 27 and 28, and the handgrip 7, etc. are incorporated as components, so that no special tools are needed.

In the foregoing embodiment, the rubber roller 2*c* is adapted to roll on the metal roller 2*a* (FIGS. 3(*b*) to 3(*c*)). However, the rubber roller 2*c* need not roll on the metal roller 2*a*, and may make contact with the metal roller 2*a* (or metal rollers 2*a*, 2*b*) at the position shown in FIG. 3(*c*) (the rotation center of the roller arm may be eccentric with respect to the axis of the metal roller). Moreover, the roller arm 6 may be free to pivot (swing) relative to the frame 3.

Second Embodiment

Figure 5:
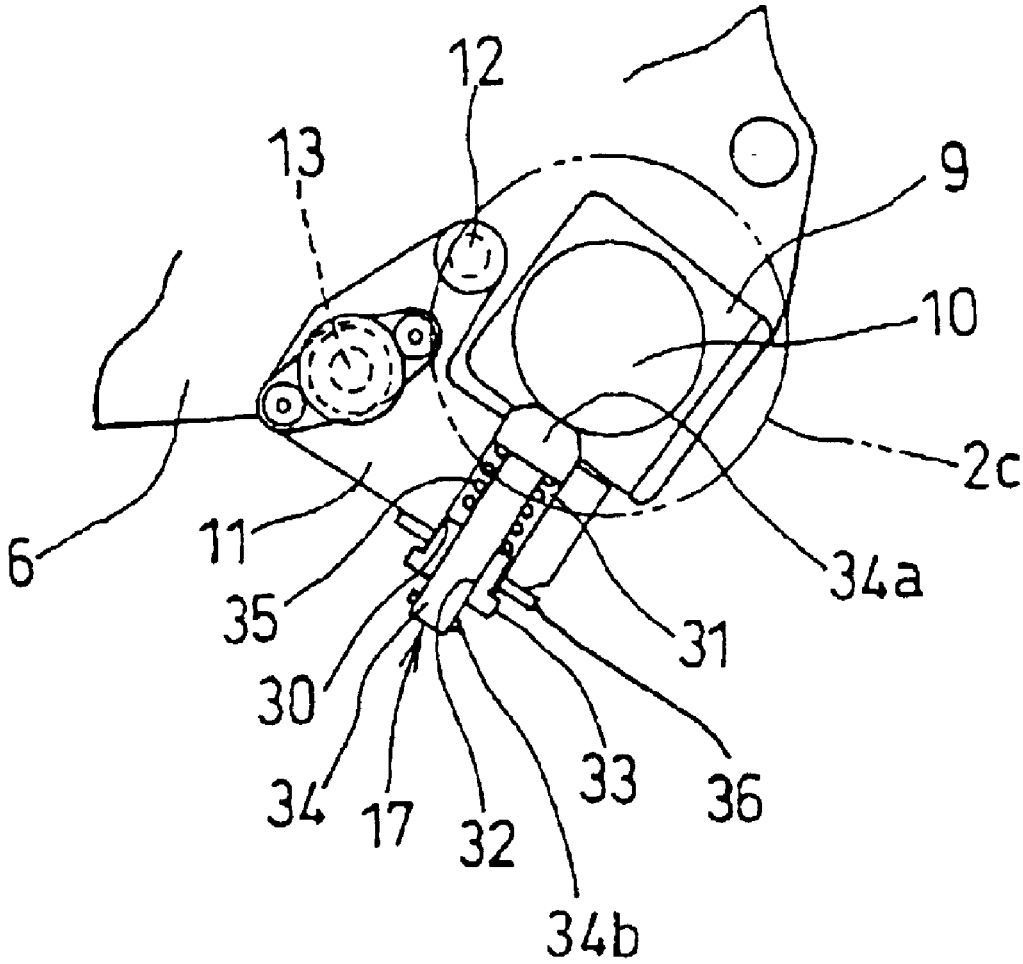
FIG. 5 is a side view of a holder portion showing a second embodiment of the present invention.

FIG. 5 is a side view of the holder portion showing a second embodiment of the present invention.

This is an embodiment, in which the pressing member 17 of the holder 11 in the first embodiment, is provided with pressing force adjusting means for adjusting the pressing force of the pressing member 17. In the illustrated embodiment, the pressing member 17 comprises a hole (first hole) 31 provided in the holder 11 and having a threaded portion 30 formed in the inside thereof; an adjusting screw 33 screwed into the threaded portion 30 of the hole 31 and provided with a hole 32; a pin (first pin) 34 inserted into the hole 32 of the adjusting screw 33 and having a contact portion 34*a* in contact with the rubber roller 2*c*; a compression spring (first elastic member) 35 interposed between the adjusting screw 33 and the contact portion 34*a* of the pin 34; and a locking nut 36 for preventing the loosening of the adjusting screw 33. A stopper 34*b* is provided in the pin 34. The stopper 34*b* is designed to prevent the pin 34 from escaping from the holder 11 when the holder 11 is pivoted (swung) from the position of FIG. 3(*b*) to the position of FIG. 3(*a*). Other constructions are the same as in the first embodiment.

According to the present embodiment, the degree to which the adjusting screw 33 is screwed in is changed, whereby the spring load of the compression spring 35 is varied. As a result, the pressing force of the pressing member 17 is changed, whereby the nip pressure of the rubber roller 2*c* against the metal rollers 2*a*, 2*b* can be adjusted arbitrarily.

Third Embodiment

Figure 6:
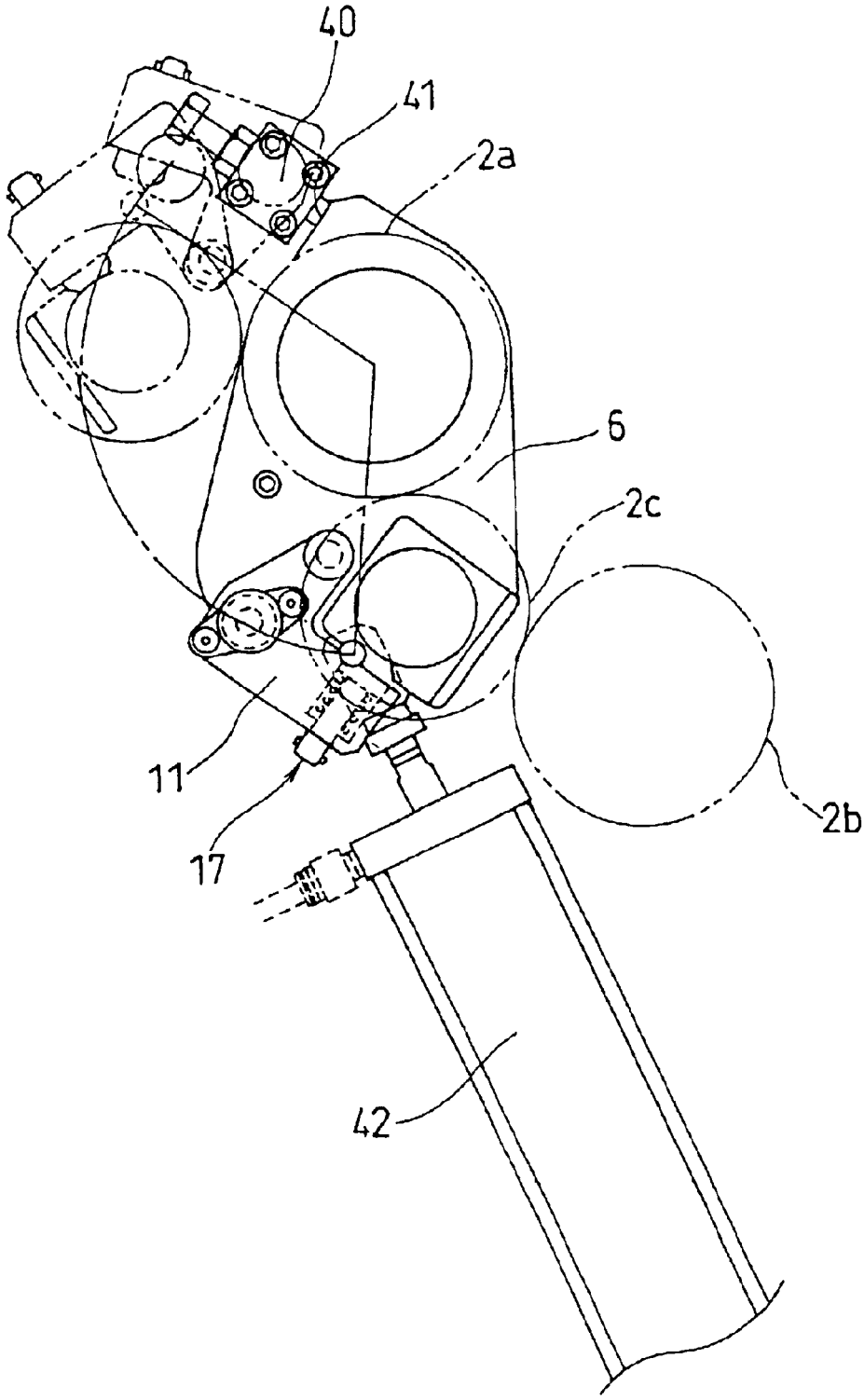
FIG. 6 is a side view of the essential parts of an inking device showing a third embodiment of the present invention.
Figure 7:
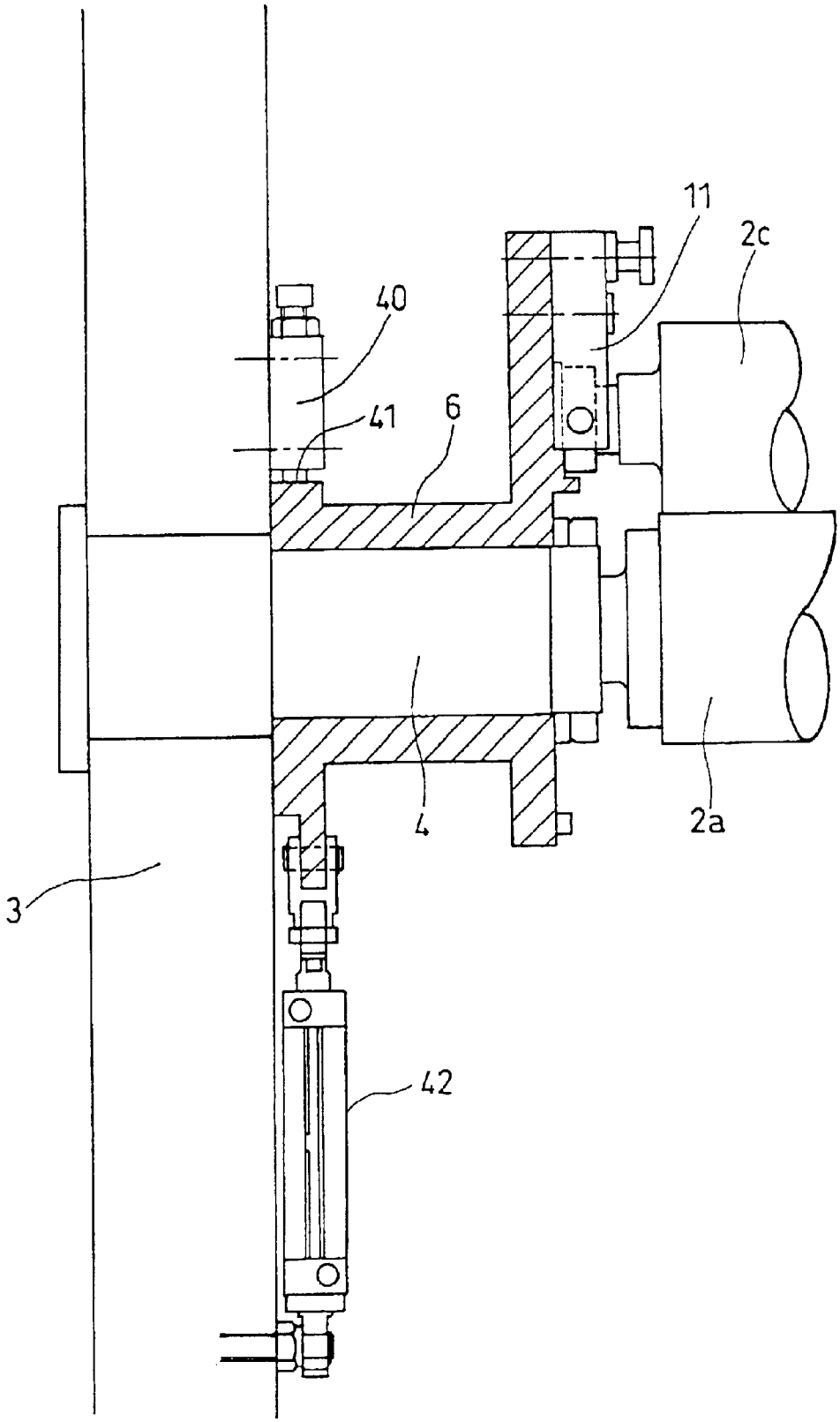
FIG. 7 is a partly cutaway, developed plan view of the essential parts of the inking device.

FIG. 6 is a side view of the essential parts of an inking device showing a third embodiment of the present invention. FIG. 7 is a developed plan view of the essential parts of the inking device.

This is an embodiment, in which the holding means in the first embodiment for selectively positioning and fixing the roller arm 6 at the printing position and the replacement/mounting position of the rubber roller 2*c*, is composed of a stopper member 40 fixed on the frame 3 and positionally adjustable by the degree of screwing-in; a stopper portion 41 provided in the roller arm 6 and capable of contacting the stopper member 40; and an air cylinder (actuator) 42 having a piston rod front end pivotally connected to the roller arm 6 and a cylinder portion pivotally supported by the frame 3. Other constructions are the same as in the first embodiment.

According to this embodiment, the air cylinder 42 is contracted to bring the stopper portion 41 into contact with the stopper member 40, whereby the roller arm 6 can be held at the printing position of the rubber roller 2*c* (see solid lines shown in FIG. 6). On the other hand, the air cylinder 42 is expanded, whereby the roller arm 6 can be held at the replacement/mounting position of the rubber roller 2*c* (see chain lines shown in FIG. 6). This actuation of the air cylinder 42 can be performed by remote control.

In the present embodiment, the stopper member 40, the stopper portion 41, and the air cylinder 42 constitute the holding means. The holding means holds the roller arm 6 by the stopper member 40, the stopper portion 41, and the air cylinder 42 when the rubber roller 2*c* is located at the printing position. When the rubber roller 2*c* is located at the replacement/mounting position, the holding means holds the roller arm 6 by the air cylinder 42.

In the present embodiment, moreover, the roller arm 6 is pivoted (swung) by the air cylinder 42, but a handgrip may be provided as in the other embodiments. Furthermore, a surface of the roller arm 6, which defines the stopper portion 41, is brought into contact with the stopper member 40. However, a bracket may be mounted on the roller arm 6, and this bracket may make contact with the stopper member 40.

Fourth Embodiment

Figure 8:
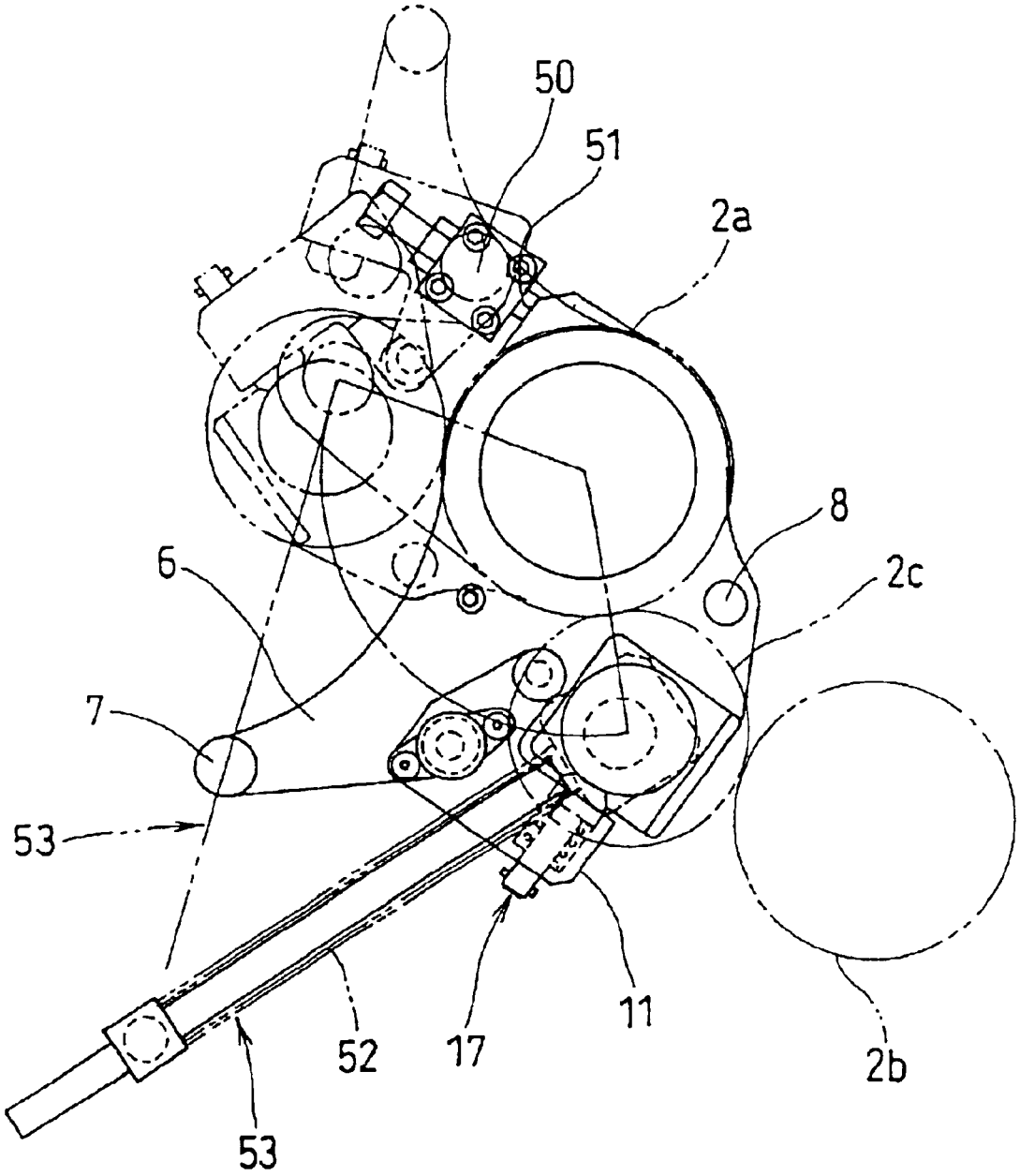
FIG. 8 is a side view of the essential parts of an inking device showing a fourth embodiment of the present invention.
Figure 9:
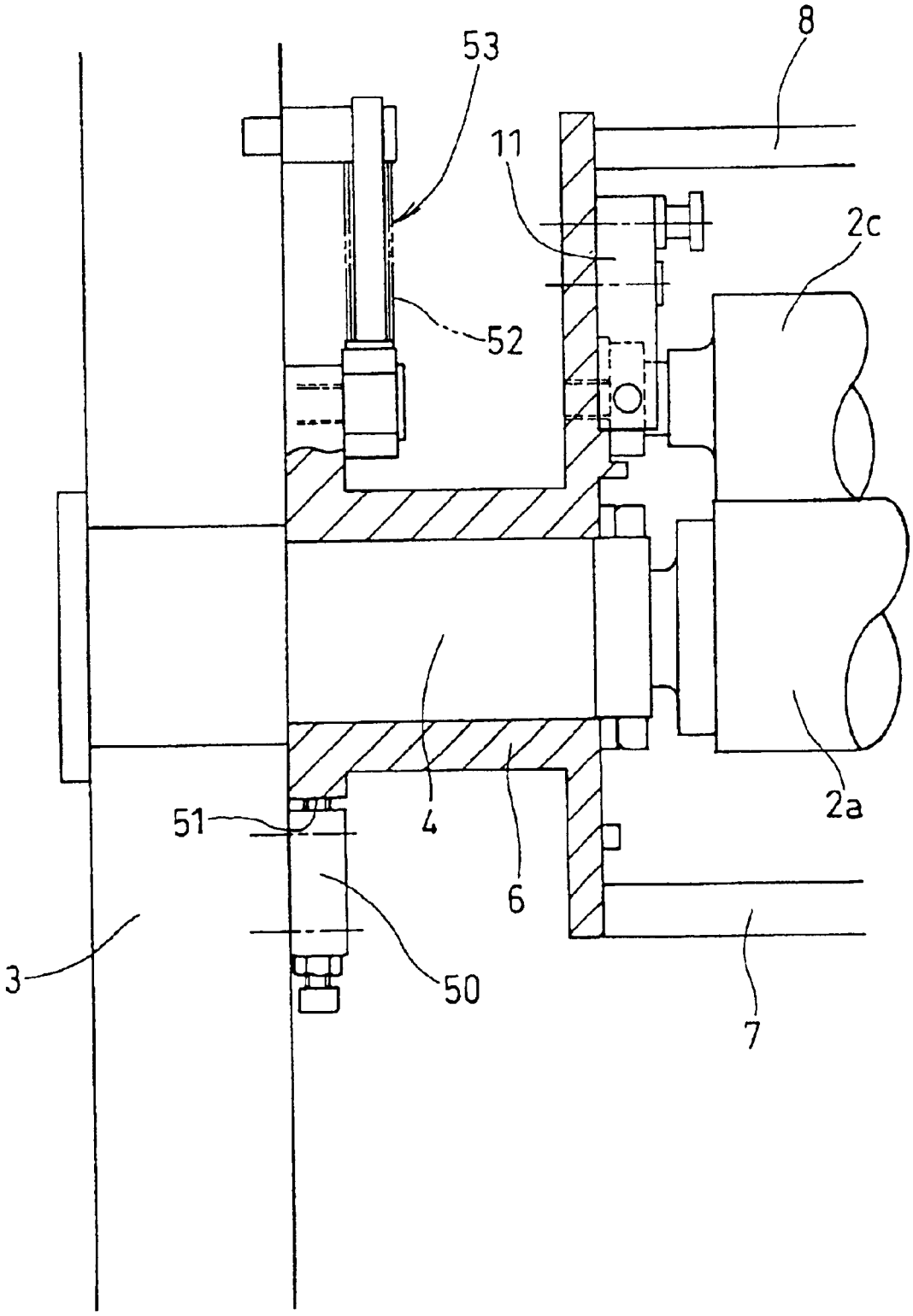
FIG. 9 is a partly cutaway, developed plan view of the essential parts of the inking device.

FIG. 8 is a side view of the essential parts of an inking device showing a fourth embodiment of the present invention. FIG. 9 is a developed plan view of the essential parts of the inking device.

This is an embodiment, in which the holding means in the first embodiment for selectively positioning and fixing the roller arm 6 at the printing position and the replacement/mounting position of the rubber roller 2*c*, is composed of a stopper member 50 fixed on the frame 3 and positionally adjustable by the degree of screwing-in; a stopper portion 51 provided in the roller arm 6 and capable of contacting the stopper member 50; and a roller arm urging/fixing member (third elastic member) 53 provided with a compression spring 52 and having an operating end pivotally connected to the roller arm 6. Other constructions are the same as in the first embodiment.

According to this embodiment, simply by switching the handgrip 7 between two positions, the roller arm 6 is automatically and selectively positioned and fixed at the printing position and the replacement/mounting position of the rubber roller 2*c* under the spring force of the compression spring 52. That is, when the handgrip 7 is brought to a solid-line position shown in FIG. 8, the stopper portion 51 is brought into contact with the stopper member 50 by the spring force of the roller arm urging/fixing member 53 equipped with the compression spring 52, whereby the roller arm 6 can be held at the printing position of the rubber roller 2*c* (see solid lines shown in FIG. 8). On the other hand, the handgrip 7 is brought to a chain-line position shown in FIG. 8 by once contracting the compression spring 52 during the pivoting (swinging) of the roller arm 6. In this case, the roller arm 6 can be held at the replacement/mounting position (see chain lines shown in FIG. 8) of the rubber roller 2*c* by the spring force of the roller arm urging/fixing member 53 equipped with the compression spring 52. At this replacement/mounting position of the rubber roller 2*c* as well, a stopper (not shown) for confining the roller arm 6 to this position may be provided in the frame 3.

In the present embodiment, the stopper member 50, the stopper portion 51, and the roller arm urging/fixing member 53, equipped with the compression spring 52, constitute the holding means. The holding means holds the roller arm 6 by the stopper member 50, the stopper portion 51, and the roller arm urging/fixing member 53 equipped with the compression spring 52, when the rubber roller 2*c* is located at the printing position. When the rubber roller 2*c* is located at the replacement/mounting position, the holding means holds the roller arm 6 by the roller arm urging/fixing member 53 equipped with the compression spring 52.

Fifth Embodiment

Figure 10:
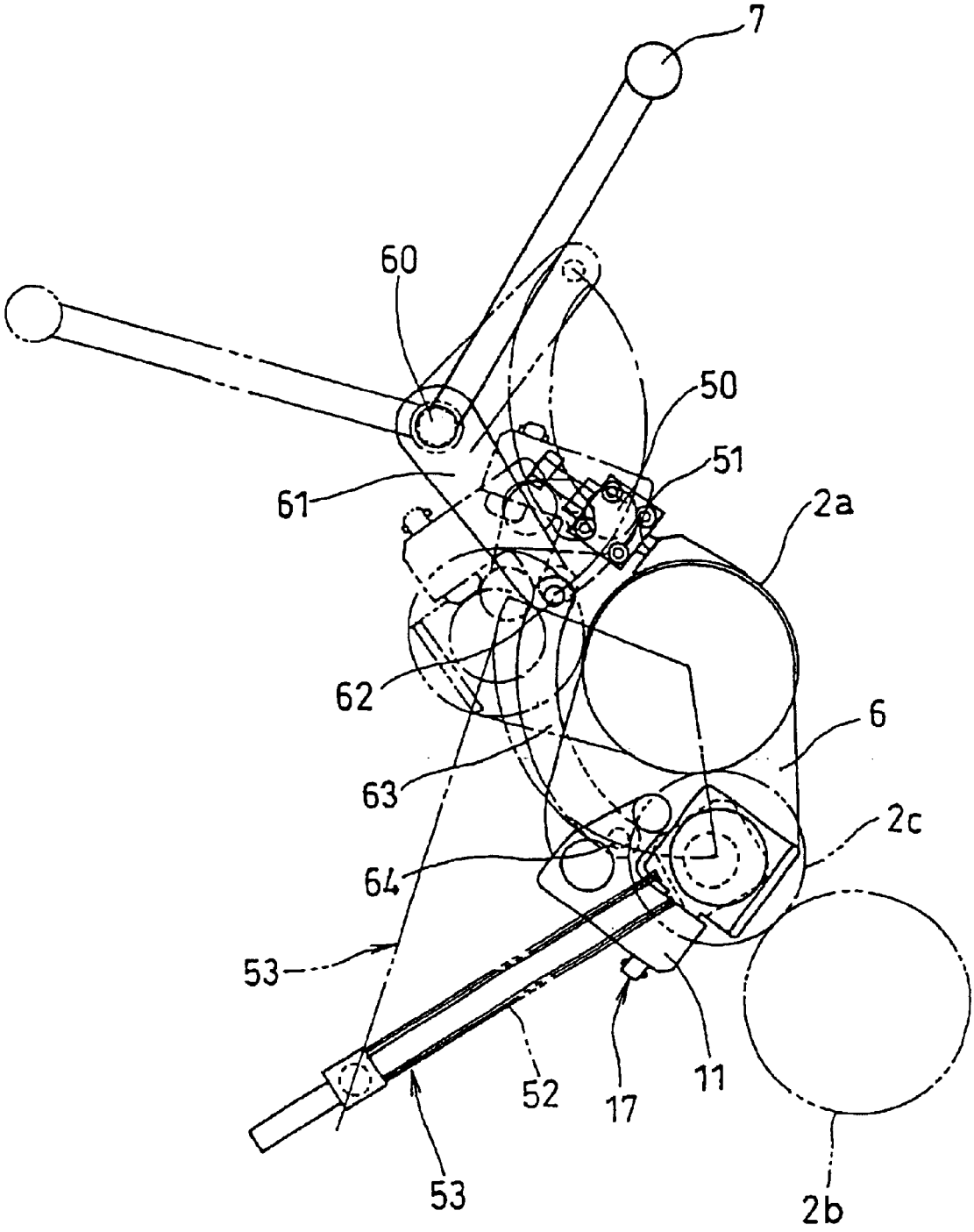
FIG. 10 is a side view of the essential parts of an inking device showing a fifth embodiment of the present invention.
Figure 11:
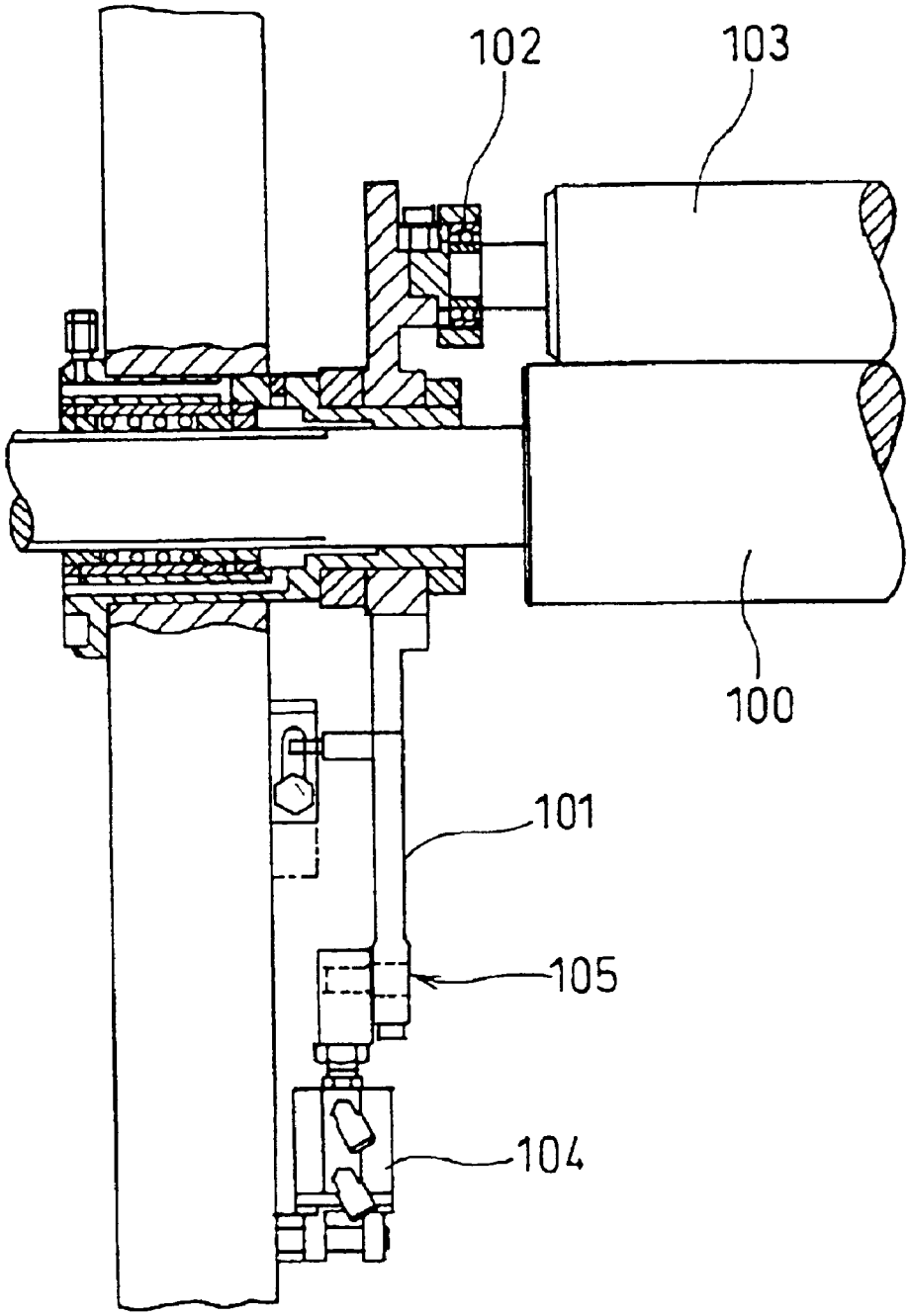
Fig. 11 PRIOR ART
FIG. 11 is a partly cutaway, front view of a conventional roller holding apparatus.
Figure 12:
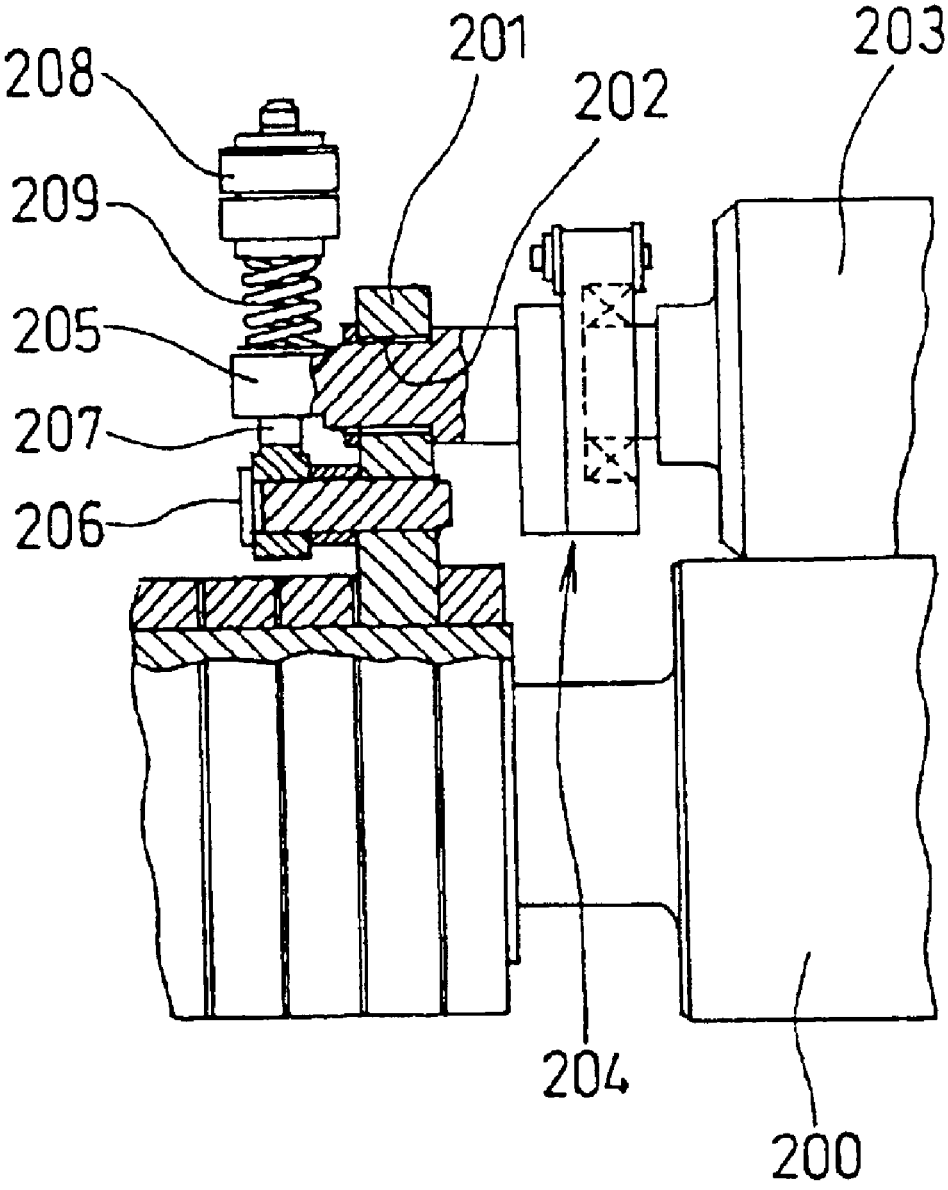
Fig. 12 PRIOR ART
FIG. 12 is a partly cutaway, front view of a conventional nip pressure adjusting device.

FIG. 10 is a side view of the essential parts of an inking device showing a fifth embodiment of the present invention.

In this embodiment, the handgrip 7 in the fourth embodiment is channel-shaped when viewed in a front view. Its right and left end shaft portions 60 are pivotally supported on the frame 3 (see FIG. 9). A lever 61 is integrally connected to the shaft portion 60. An arcuate link 63 has one end portion pivotally connected to the front end of the lever 61 by a pin 62, and has the other end portion pivotally connected to the roller arm 6 by a pin 64. When the handgrip 7 is pivoted from a solid-line position to a chain-line position (or vice versa) shown in FIG. 10, the roller arm 6 is pivoted (swung) from the printing position of the rubber roller 2*c* (see solid lines shown in FIG. 10) to the replacement/mounting position of the rubber roller 2*c* (see chain lines shown in FIG. 10) (or vice versa) via the lever 6 and the arcuate link 63. Other constructions are the same as in the fourth embodiment.

According to the present embodiment, the same actions and effects as in the fourth embodiment are produced, and the degree of freedom is present in the disposition of the handgrip 7. The handgrip 7 can be disposed easily at a position where it is easy to handle.

While the present invention has been described by the foregoing embodiments, it is to be understood that the invention is not limited thereby, but may be varied in many other ways. Such variations are not to be regarded as a departure from the spirit and scope of the invention, and all such modifications as would be obvious to one skilled in the art are intended to be included within the scope of the appended claims.

What is claimed is:

1. A roller holding apparatus of a printing press, comprising:

a first roller;

an arm having a support portion for rotatably supporting a second roller, the arm being adapted to selectively swing between a printing position in which the second roller is placed in a holding position where the second roller is in contact with said first roller and a third roller, and a replacement position in which the second roller is held in a release position where the second roller is separated from the third roller;

a holder supported by said arm and selectively swingable between a holding position in which the second roller is held by said arm, and a release position in which the second roller is allowed to be released from the arm, the holder swinging to the release position when the arm is in the replacement position;

a pressing member, provided in said holder, for pressing the second roller against said first roller, said pressing member including a first pin provided with a contact portion in contact with the second roller, and a first elastic member that urges said first pin in a direction in which the second roller is pressed against said first roller via said contact portion when said holder is in the holding position, and said pressing member presses the second roller against said first roller and the third roller via said contact portion when said arm is in the printing position;

a second pin that engages said holder and said arm for maintaining said holder at the holding position when said holder is in the holding position; and a second elastic member that urges said second pin in a direction in which said holder and said arm engage each other, such that said holder is allowed to be moved to said release position by moving said second pin against an urging force of said second elastic member, wherein when said holder is in said holding position while said arm is in said replacement position, the second roller is held in contact with said contact portion, being urged towards the second roller by said first elastic member, said support portion, and said first roller, and wherein when said holder is in the release position while said arm is in the replacement position, the second roller is held in contact only with said support portion and said first roller, and the second roller is replaced through a space opened upon movement of said holder to the release position.

2. The roller holding apparatus of a printing press according to claim 1, wherein said pressing member further includes, pressing force adjusting means for adjusting a pressing force of said pressing member.

3. The roller holding apparatus of a printing press according to claim 2, wherein said pressing member further includes, a first hole provided in said holder and having a threaded portion provided in an inside thereof, an adjusting screw screwed into said threaded portion of said first hole and having a hole, said first pin is inserted into said hole of said adjusting screw, and said first elastic member is interposed between said adjusting screw and said contact portion of said first pin.

4. The roller holding apparatus of a printing press according to claim 1, further comprising:

a second hole provided in one of said arm and said holder, wherein said second pin is provided in other of said arm and said holder, and said second elastic member urges said second pin toward said second hole.

5. The roller holding apparatus of a printing press according to claim 1, further comprising:

holding means for holding said arm at a replacement position where the second roller is replaced, and at a printing position where the second roller contacts the third roller.

6. The roller holding apparatus of a printing press according to claim 5, wherein said holding means includes, first and second brackets fixed to a frame of said printing press, depressions provided in said first and second brackets or in said arm, and a fixing pin provided in said arm when said depressions are provided in said first and second brackets, or said fixing pin being provided in said first and second brackets when said depressions are provided in said arm, and said fixing pin being insertable into said depression provided in said first and second brackets or in said arm.

7. The roller holding apparatus of a printing press according to claim 5, wherein said holding means includes, a stopper member fixed to a frame of said printing press, a stopper portion provided in said arm, and an actuator pivotally supported by said arm.

8. The roller holding apparatus of a printing press according to claim 5, wherein said holding means includes, a stopper member fixed to a frame of said printing press, a stopper portion provided in said arm, and a third elastic member pivotally supported by said arm.

9. The roller holding apparatus of a printing press according to claim 1, wherein said arm is provided with a handgrip for swinging said arm.

10. The roller holding apparatus of a printing press according to claim 1, wherein said first elastic member includes a spring, and when said arm is located in the printing position, the second roller imparts a constant pressure against said first roller and the third roller due to the urging force of said spring.

* * * * *